US009334144B2

(12) United States Patent
Upah et al.

(10) Patent No.: US 9,334,144 B2
(45) Date of Patent: May 10, 2016

(54) BREAKAWAY WINCH BRACKET AND METHOD OF MOUNTING SAME

(71) Applicant: HONDA MOTOR CO., LTD., Tokyo (JP)

(72) Inventors: Adam J. Upah, Cable, OH (US); Matthew Lee Taracko, Marysville, OH (US); Kurt Robert Blankemeyer, Dublin, OH (US); Dakota D. Kirtland, Bluffton, OH (US); Prince Rodriguez, Powell, OH (US); Jeremy T. McGuire, Powell, OH (US); Hiroshi Okazaki, Columbus, OH (US); Hidemi Minami, Dublin, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 165 days.

(21) Appl. No.: 14/184,959

(22) Filed: Feb. 20, 2014

(65) Prior Publication Data

US 2015/0232306 A1 Aug. 20, 2015

(51) Int. Cl.
*B66D 3/26* (2006.01)
*B66D 1/00* (2006.01)

(52) U.S. Cl.
CPC ..... *B66D 1/00* (2013.01); *Y10T 29/49826* (2015.01); *Y10T 29/49947* (2015.01)

(58) Field of Classification Search
CPC ..... B60R 19/34; B60R 19/14; B60R 19/40; B60R 19/48; B60R 2019/522; B27D 1/02; B27D 1/04
USPC ..... 144/348; 267/139, 162; 29/428; 296/187.09; 293/133, 1, 120, 135, 150, 293/155, 9
See application file for complete search history.

(56) References Cited

U.S. PATENT DOCUMENTS

| | | | | |
|---|---|---|---|---|
| 3,751,089 | A | 8/1973 | Lefeuvre | |
| 3,759,351 | A | 9/1973 | Purple | |
| 4,225,167 | A | 9/1980 | Buettner et al. | |
| 6,224,120 | B1 * | 5/2001 | Eipper | B60R 19/40 293/115 |
| 2005/0099028 | A1 | 5/2005 | Orton | |
| 2007/0252396 | A1 * | 11/2007 | Kang | B60R 19/52 293/115 |
| 2011/0006553 | A1 * | 1/2011 | Fretz | B60R 19/48 293/115 |
| 2011/0226830 | A1 | 9/2011 | West, Jr. | |
| 2012/0145980 | A1 * | 6/2012 | Harrison | B60D 1/02 254/323 |
| 2013/0134724 | A1 * | 5/2013 | Fisher | B60R 19/54 293/142 |

FOREIGN PATENT DOCUMENTS

| | | | |
|---|---|---|---|
| AU | 200216790 | B2 | 9/2002 |
| AU | 2012202001 | A1 | 10/2012 |

OTHER PUBLICATIONS

PANGAEA Expeditions web pages; printed from http://www.pangaea-expeditions.com/arbbullbars on Aug. 26, 2013; 6 pages.
Metal Tech web pages; printed from http://www.metaltech4×4.com/p-29-fj-cruiser-tube-bumper-wwinch-mount.aspx on Aug. 26, 2013; 2 pages.
Promark Offroad web page; printed from http://www.promarkoffroad.com/winch-mounting-plates/atv-utv-sxs-mounts on Aug. 29, 2013; 1 page.

* cited by examiner

*Primary Examiner* — Glenn Dayoan
*Assistant Examiner* — Sunsurraye Westbrook
(74) *Attorney, Agent, or Firm* — Kenealy Vaidya LLP

(57) ABSTRACT

A winch bracket assembly and method of mounting same on an associated vehicle includes a winch bracket extending from an end of a frame of the vehicle. A mounting arrangement secures the winch bracket to the frame of the associated vehicle and allows the winch bracket to have high rigidity relative to the frame in a first direction and a different, low rigidity relative to the frame in a second direction.

20 Claims, 6 Drawing Sheets

BREAKAWAY WINCH BRACKET AND METHOD OF MOUNTING SAME

BACKGROUND

The present exemplary embodiment relates to vehicles. It finds particular application in conjunction with a bracket or mounting associated with a winch mounted on the vehicle and a method of mounting the bracket to the vehicle, and will be described with particular reference thereto. However, it is to be appreciated that the present exemplary embodiment is also amenable to other like applications.

It is common in certain types of vehicles, such as off-road or all-terrain vehicles (ATV), to provide a winch assembly that is mounted on the vehicle. The winch assembly includes a line such as a cable, wire, rope, etc., that is wound on a spool or drum and let out or wound in by rotating the drum. Electric, hydraulic, internal combustion drive, or manual actuation of the drum can be provided. The winch assembly is normally received on a bracket, mounting plate, or platform (referred to hereafter as a bracket) that is secured to the vehicle. One common area for mounting the bracket is adjacent the front bumper, and oftentimes the bracket is structurally interconnected with the front bumper and/or frame. Protective tubing or bars are provided as a part of the bracket to provide protection to the winch assembly received on the bracket.

Currently, winch assemblies are installed to the front of the vehicle via a mounting structure that is rigid in all directions. The rigidity is desirable with regard to strength and durability, however, the rigid mount affects deformation of the vehicle in a collision event. Specifically, the rigid mounting of the bracket generally does not allow deformation in the mounting area during a collision event and thus input loads transferred to the vehicle remain high. Prior arrangements triangulate the front bumper structure and remain very stiff in a collision event, i.e. the bracket does not collapse or absorb energy as desired. As a result of this rigid mounting arrangement of the winch bracket, a force or load can stay above lower frame tubes causing a large moment/torque to affect the bracket. The winch bracket is too rigidly attached to the bumper and affects the collapse of the bumper.

Accordingly, a need exists for a bracket that retains the advantages of mounting a winch to an associated vehicle, and overcomes the above noted problems and others in a manner that is simple, easy to manufacture, economical, and effective.

BRIEF DESCRIPTION

The present disclosure is directed to a breakaway winch bracket for mounting a winch to an associated vehicle, and a method of mounting a bracket to the vehicle.

The winch bracket assembly includes a winch bracket extending from an end of the associated vehicle frame. A mounting arrangement secures the winch bracket to the frame and is configured to allow the winch bracket to have high rigidity relative to the frame in a first direction and a different, low rigidity relative to the frame in a second direction.

The bracket includes first and second flanges disposed in spaced relation, and secured to the associated frame member with respective fasteners.

The flanges each include a hook-shaped member for operative engagement by the fastener.

The first and second hook-shaped members are oriented in the same direction so that a predetermined force imposed thereon toward an interior bight portion of the hook-shaped members separates the first and second hook-shaped members from the associated frame member in a collision event.

A method of mounting a winch bracket assembly to a vehicle includes providing a frame of the associated vehicle, providing a winch bracket, and securing the winch bracket to the frame at one end of the associated vehicle so that the winch bracket has a high rigidity relative to the frame in a first direction and a different, low rigidity relative to the frame in a second direction.

The method further includes using a fastener to secure a portion of the winch bracket to the frame, including orienting a hook-shaped member such that an open portion of the hook shape is disposed forwardly of the closed end of the hook shape.

The new winch bracket advantageously allows the winch bracket to have high rigidity relative to the frame in a first direction and a different, low rigidity relative to the frame in a second direction.

The winch bracket slips between vertical frame pipes which support the front bumper during a collision event.

The new winch bracket has a high rigidity relative to the frame in a first direction and a different, low rigidity relative to the frame in a second direction.

Still other benefits and advantages of the present disclosure will become more apparent from reading and understanding the following detailed description.

DETAILED DESCRIPTION

Figure 1:
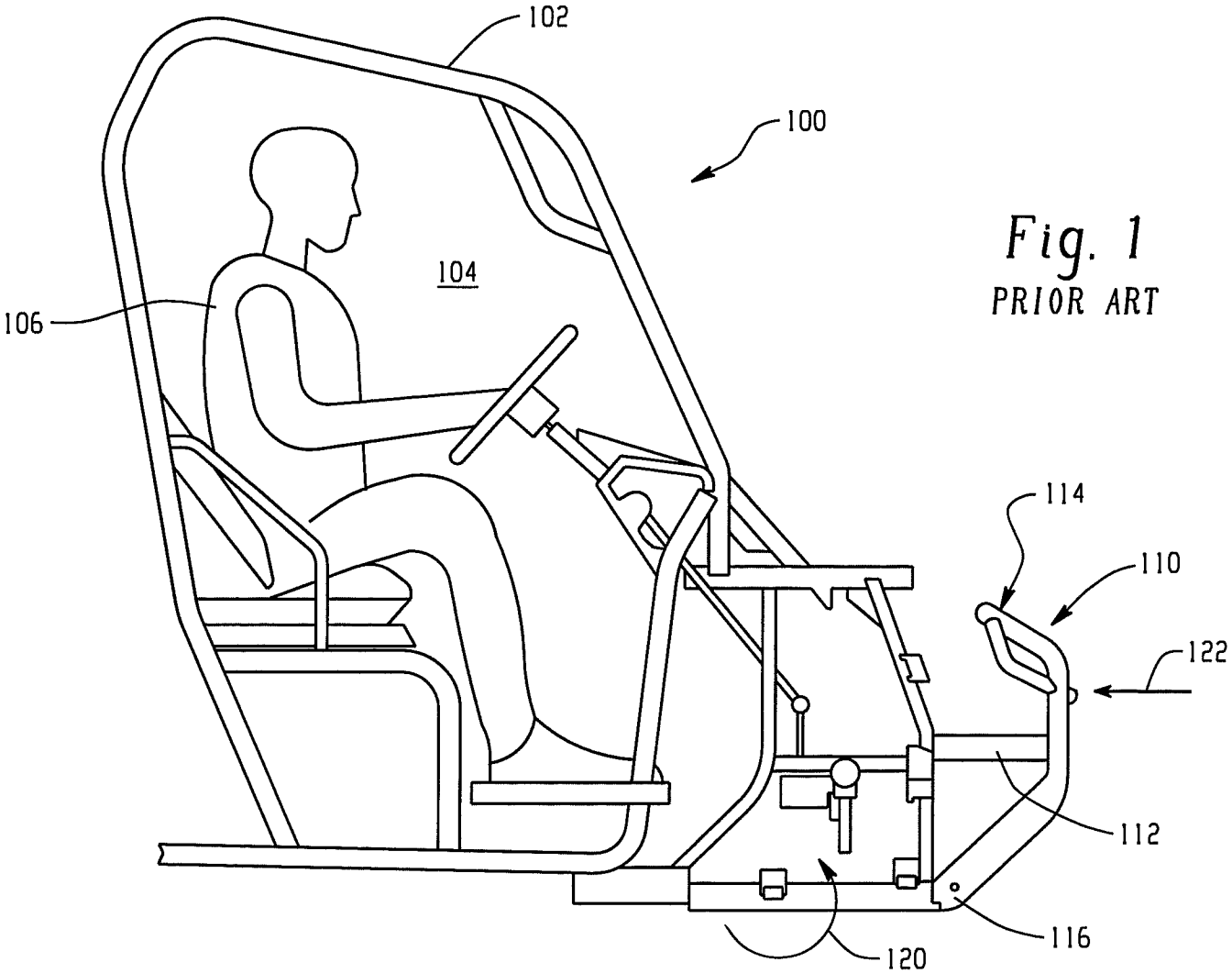
Fig. 1 PRIOR ART
FIG. 1 shows a front end of a vehicle with a winch bracket attached thereto and the arrows illustrate a large moment/torque imposed on the front end of the vehicle in response to a collision event force on the winch bracket.
Figure 2:
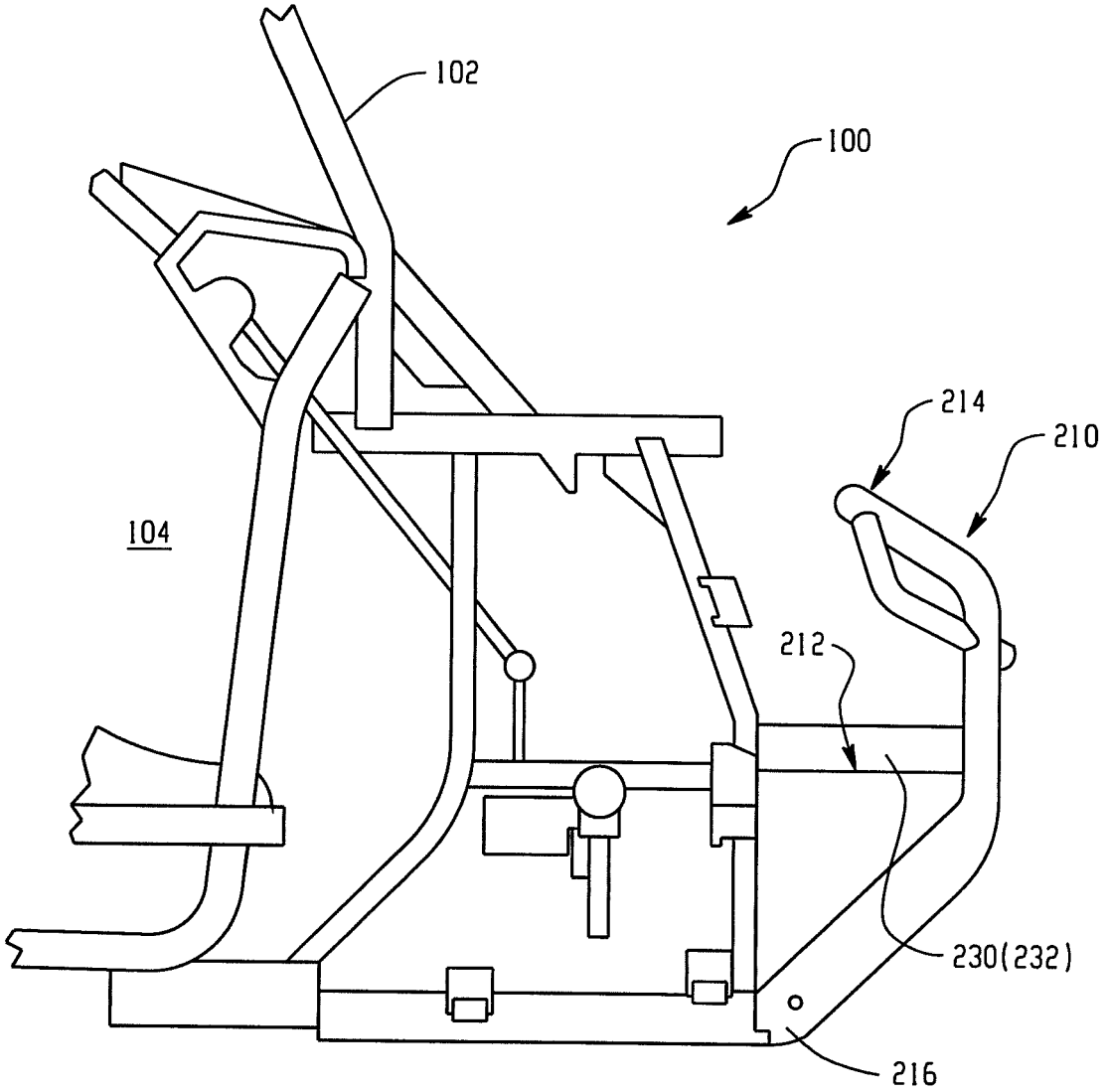
FIG. 2 is an enlarged view of the front end of the vehicle with the winch bracket.
Figure 3:
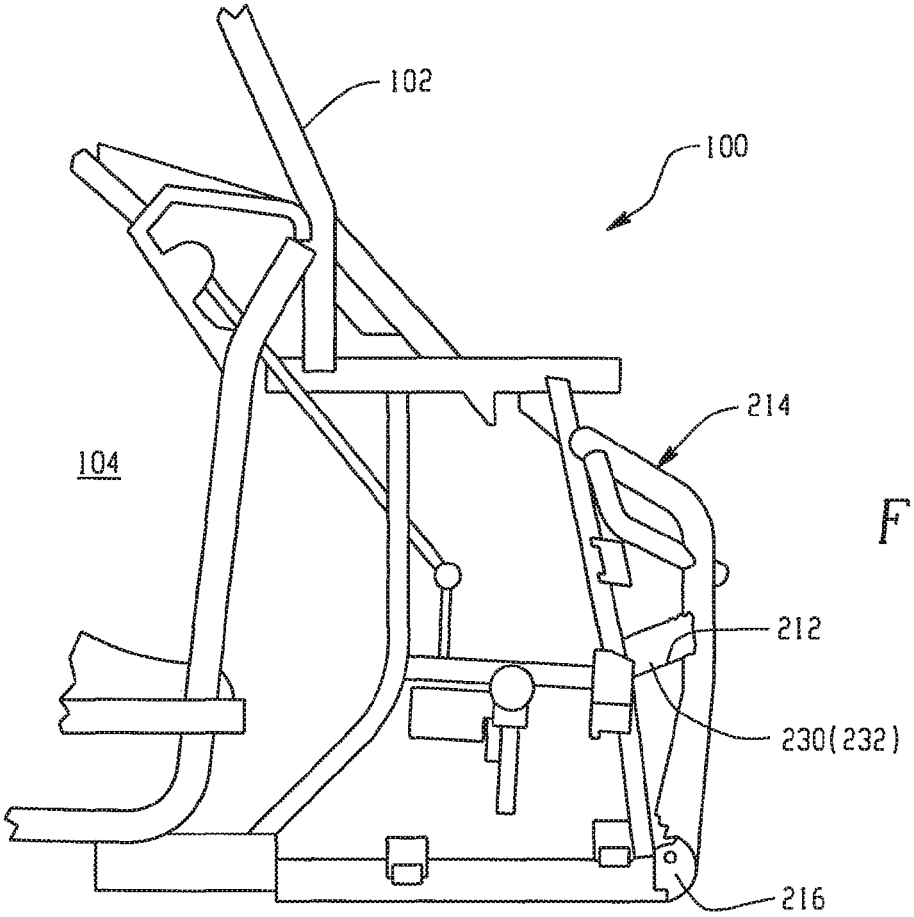
FIG. 3 shows how the new winch bracket breaks away and rotates rearwardly.

Turning first to FIG. 1, there is shown generally portions of a vehicle 100 including a vehicle frame 102 constructed around a vehicle compartment 104 that receives one or more occupants 106. Additional details of the vehicle have been removed for ease of illustration. Mounted to a front end of the vehicle 100 is a conventional winch bracket 110 that includes a planar surface 112 that covers a winch (not shown) and protective framework such as tubing 114 that partially enshrouds a forward end of the planar surface. The conventional winch bracket 110 is rigidly secured to the frame 102 so that the winch bracket demonstrates rigidity in the fore (rear-to-front) and aft (front-to-rear) directions. That is, the conventional winch bracket 110 when installed on the vehicle 100 is intended to provide rigidity and strength, generally forming a triangular connection with the vehicle frame 102 with the planar surface 112 connecting to the frame, as well as a lower end 116 of the tubing 114. It is common for the winch bracket 110 to be mounted to and share front bumper mounts of the vehicle. The mounting arrangement of the winch bracket 110 presents a very stiff structure in a collision event that does not collapse or absorb energy. This is represented by the large moment or torque represented by arrow 120 that is imposed on the frame 102 in response to forces encountered in a collision event as generally represented by arrow 122 on the winch bracket 110.

Figure 4:
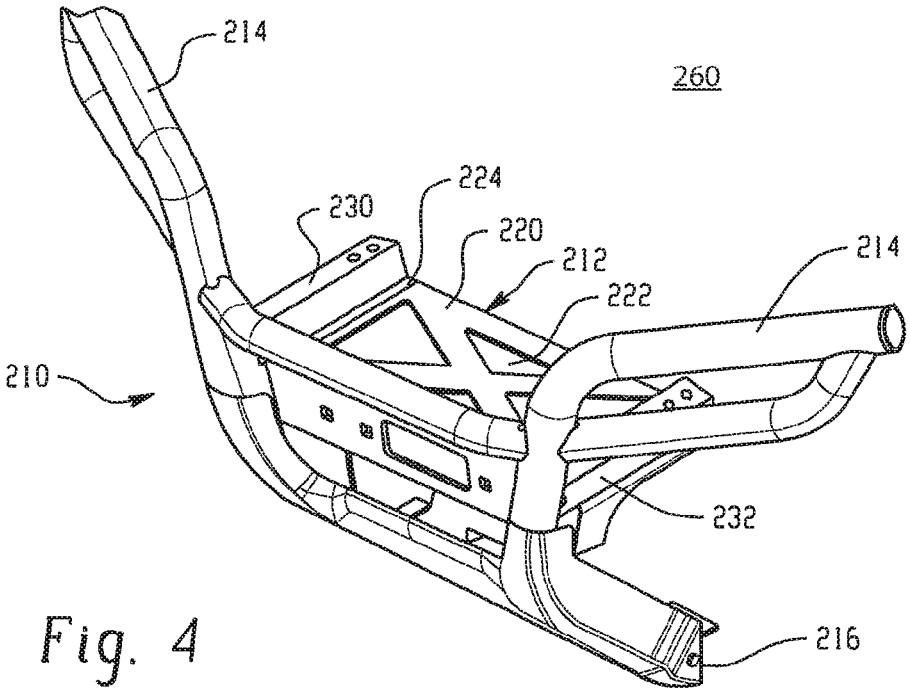
FIG. 4 is a perspective view of the subject winch bracket.
Figure 5:
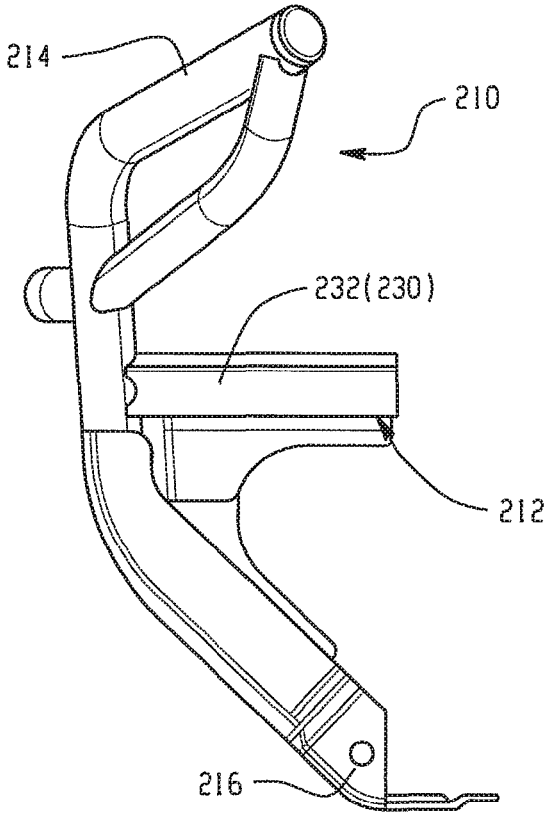
FIG. 5 is an enlarged elevational view of the winch bracket of FIG. 4.
Figure 6:
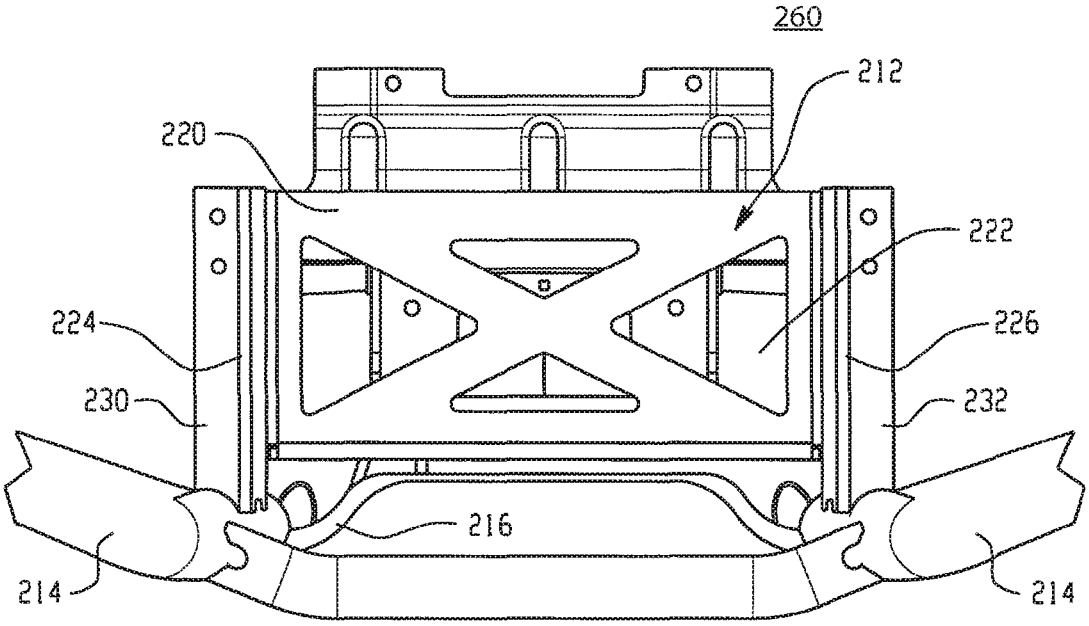
FIG. 6 is a top view of the winch bracket of FIG. 4.
Figure 7:
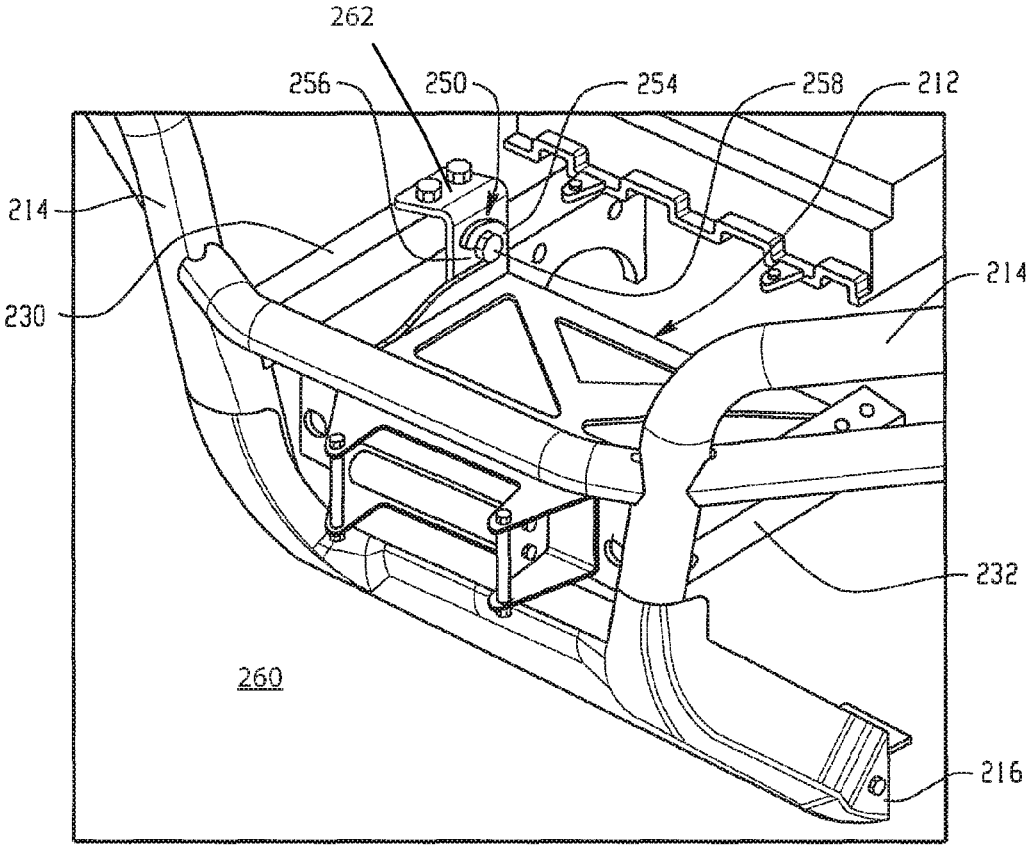
FIG. 7 is a perspective view of the mounting arrangement for the winch bracket of FIG. 4, which is secured to the front end of a vehicle.
Figure 8:
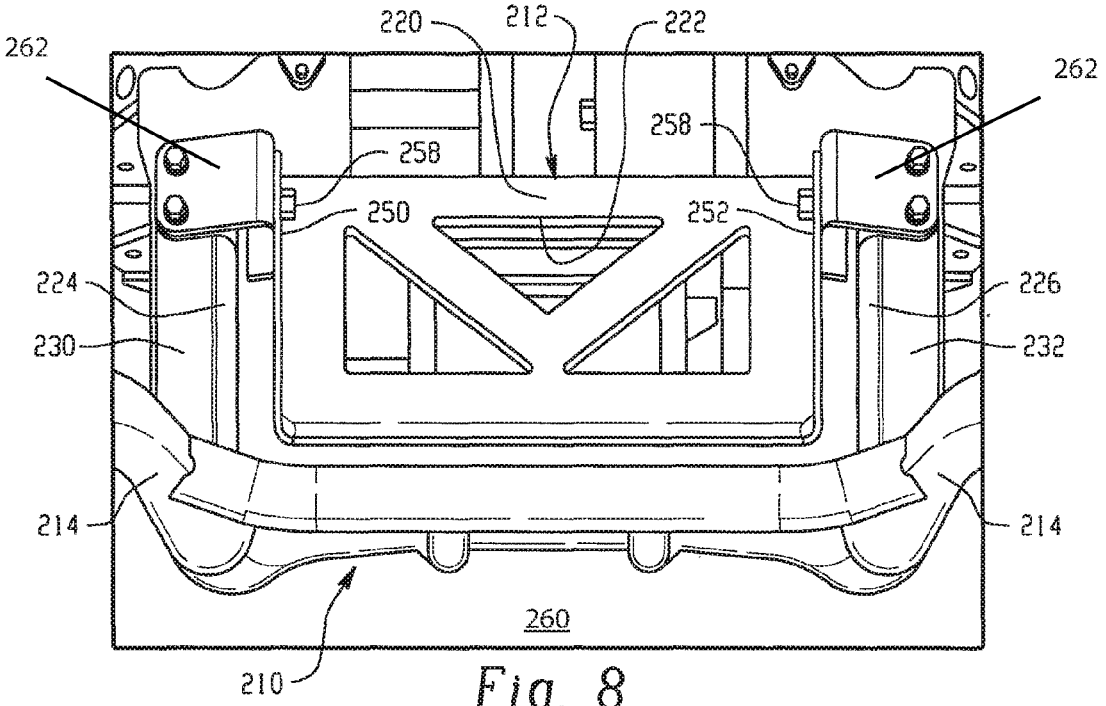
FIG. 8 is a top view of the mounting arrangement for the winch bracket of FIG. 4 secured to the vehicle.
Figure 9:
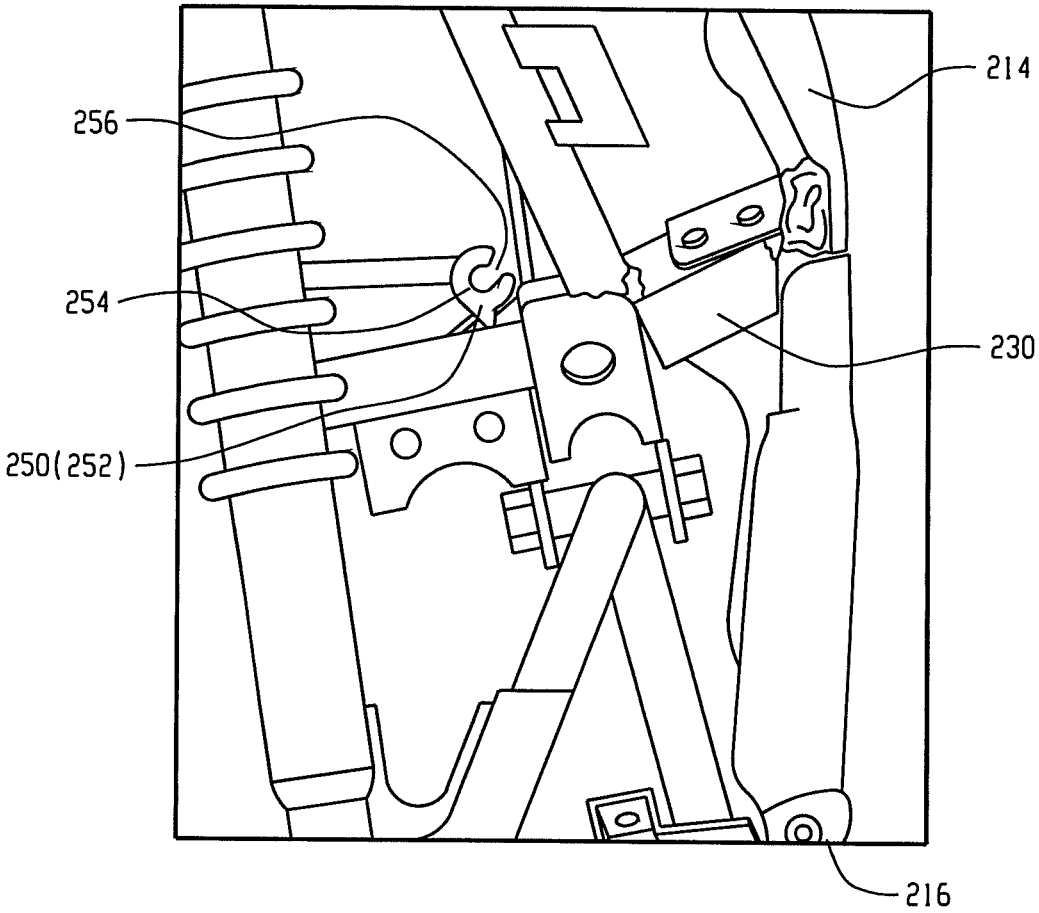
FIG. 9 is a view similar to FIG. 3.

An improved mounting arrangement of winch bracket 210 is shown in FIGS. 2-9. For ease of illustration and understanding, like reference numerals refer to like components while new reference numerals refer to components of the improved mounting arrangement of the winch bracket 210. Planar surface 212 partially surrounds a conventional winch (not shown), while protective tubing 214 generally extends over a front end of the platform 212 for purposes of additional protection. For example, and as illustrated in FIGS. 4, 5, and 8, the winch bracket 210 has a generally planar portion 220 that includes openings 222 in a preferred arrangement to reduce the overall weight while still maintaining structural integrity. Extending from opposite edges of the planar portion 220 are first and second flanges 224, 226 which will be described in further detail below. The winch bracket is still secured to the frame at upper and lower locations, i.e. the planar portion 212 is fastened to the frame, particularly along front bumper mounts 230, 232.

Figure 10:
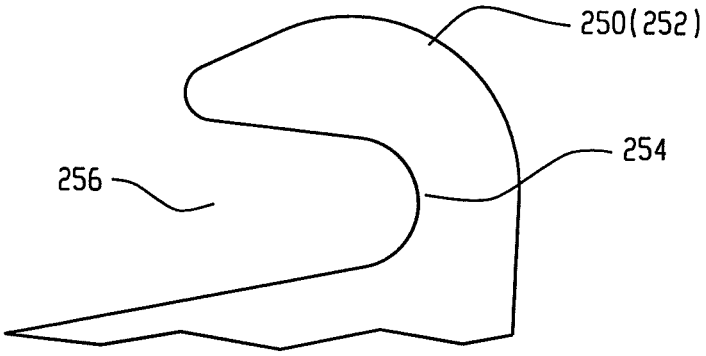
FIG. 10 is an enlarged view of a hook-shaped member of the winch bracket.

As perhaps best illustrated in FIGS. 7, 8, and 10, a mounting arrangement 260 includes each of the flanges 224, 226 of the planar portion 212 are configured to secure the winch bracket to the frame of the vehicle (namely, the bumper mounts 230, 232) using a frame member 262, so that the winch bracket has a high rigidity relative to the frame in a first direction in a different, low rigidity relative to the frame and a second direction. In one embodiment, the first direction is in the forward direction (e.g., in a direction generally from the rear toward the front of the vehicle) where forces may be imposed through the winch, and thus to the winch bracket. This is specifically achieved in the illustrated embodiment by including hook-shaped members 250, 252 provided on the flanges 224, 226 of the winch bracket 210. Each hook-shaped member 250, 252 includes a bight portion 254 opposite an open region 256 (FIG. 10). The open region 256 allows selective passage of the fastener 258, such as illustrated threaded fastener 258, that secures the hook-shaped member 250, 252 to the respective bumper mount 230, 232 of the vehicle 100.

Use of the hook-shaped members 250, 252 secured by respective fasteners 258 to the vehicle frame via the frame member 262, and specifically including the bumper mounts 230, 232, allows large forces to be transferred to the winch assembly such as when the winch is pulling a load toward the vehicle or in turn if the vehicle is being towed via the winch line. On the other hand, the opening 256 provided in each of the hook-shaped members 250, 252 (which hook-shaped members both face in the same direction) provides for a different, lower rigidity in a second direction (i.e., a force that urges the fastener 258 outwardly through the opening 256). For example, in a front end collision event large forces can be imposed on the protective tubing 214 as a result of the collision. These forces are transferred to the remainder of the winch bracket 210, including the flanges 224, 226 and the hook-shaped members 250, 252 formed in the flanges. If the forces imposed on the front of the vehicle toward the rear of the vehicle are above a predetermined value, the fastener 258 will no longer be able to hold the winch bracket planar surface 212 in position. That is, the hook-shaped members 250, 252 will separate from the respective fasteners 258. This allows the planar portion 212 of the winch bracket to rotate around the lower end 216 and improve force dissipation. Likewise, this mounting arrangement still allows the winch to be effectively used in the pulling direction, i.e. forces imposed on the winch bracket in the same direction (rear-to-front) of the vehicle are transferred into the bight portion of the hook-shaped members. The winch bracket is thus able to operate in its intended manner and convey the forces therethrough. As a result of this exemplary configuration, forces and rigidity in this direction (rear-to-front) are substantially larger than the forces and rigidity in the opposite direction (front-to-rear) encountered in a front end collision event.

In summary, the winch bracket 210 of the present disclosure is allowed to break away and rotate between the vertical frame pipes. This allows the bumper carry pipes to crush axially and absorb energy as desired. The winch bracket 210 is designed to allow the bracket to slip between the vertical frame pipes which support the front bumper. The upper bracket mounts are changed to a hook-style which is very strong in the forward (forces are transferred into the bight region of the hook shape) or the pulling direction, but the upper bracket mounts break away toward the rear in a collision event (i.e., the fastener moves away from engagement with the bight portion of the hook shape) and separates from the upper bracket mounts through the opening in the hook shape. Upon initial impact, the upper winch bracket mounts are able to break loose and rotate rearward. After the bumper pipes collapse, the impact load is transferred to the lower frame, resulting in improved force dissipation over a conventional or standard bracket. The breaking loose of the winch bracket 210 and collapse of the bumper pipes also contribute to energy absorption and aid in mitigating the deceleration of the vehicle.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

We claim:

1. A winch bracket assembly for a vehicle, the winch bracket assembly comprising:

a winch bracket extending from an end of a frame of the vehicle; and a mounting arrangement configured to secure the winch bracket to the frame of the vehicle, wherein the mounting arrangement is configured to provide the winch bracket with a connective mechanical rigidity which, under an influence of an exterior force in a first direction along a longitudinal axis of the vehicle, is higher than a connective mechanical rigidity of an equivalent exterior force exerted along a second direction of the vehicle, the second direction being anti-parallel to the first direction.

2. The winch bracket assembly of claim 1, wherein the winch bracket further includes first and second flanges disposed in a spaced relationship relative to each other.

3. The winch bracket assembly of claim 2, wherein the mounting arrangement secures the first and second flanges of the winch bracket to at least one frame member.

4. The winch bracket assembly of claim 3, wherein the mounting arrangement further includes first and second fasteners that secure the first and second flanges of the winch bracket to the at least one frame member.

5. The winch bracket assembly of claim 4, wherein the flanges each include a hook-shaped member and a fastener, the hook-shaped members exerting one of at least two different mechanical rigidities based on the direction of an externally applied force to the winch bracket assembly.

6. The winch bracket assembly of claim 5, wherein the hook-shaped members are each oriented in the same direction so that a predetermined force imposed thereon toward an interior bight portion of the hook-shaped members causes at least one of the hook-shaped members to separate from the at least one frame member during a collision event.

7. The winch bracket assembly of claim 5, wherein the frame further includes first and second frame members that support a bumper disposed to the forward of the winch bracket assembly.

8. The winch bracket assembly of claim 1, wherein the mounting arrangement further includes at least one hook-shaped member extending from the winch bracket for operative engagement by at least a first fastener.

9. The winch bracket assembly of claim 8, wherein a vehicle fixture absorbs a larger portion of a collision force than the vehicle fixture otherwise would have due to the at least one hook-shaped member becoming separated from the at least one frame member.

10. The winch bracket assembly of claim 9, wherein the mounting arrangement further includes a fixed connection between a lower portion of the winch bracket and the frame that allows the winch bracket to pivot about the lower portion when the at least one hook-shaped member separates from the at least one frame member.

11. A method of mounting a winch bracket assembly to a vehicle having a vehicle frame, comprising:

providing a winch bracket extending from an end of the frame of the vehicle;

affixing a mounting arrangement to the vehicle, the mounting arrangement being configured to secure the winch bracket to the frame of the vehicle; and configuring the mounting arrangement to cause the winch bracket to have a connective mechanical rigidity that, under an influence of an exterior force in a first direction along a longitudinal axis of the vehicle, is higher than a connective mechanical rigidity of an equivalent exterior force exerted along a second direction of the vehicle, the second direction being anti-parallel to the first direction.

12. The method of claim 11, wherein the mounting step further includes using a fastener for securing a portion of the winch bracket to the vehicle frame.

13. The method of claim 12, wherein the mounting step includes orienting at least one hook-shaped member such that an open portion of the hook shape is disposed so as to face the winch bracket.

14. The method of claim 13, wherein the mounting step further includes mounting first and second fasteners that operatively engage spaced, first and second hook-shaped members on the winch bracket.

15. The method of claim 14, wherein the mounting step includes positioning the winch bracket between vertical frame members of the vehicle whereby the winch bracket can partially separate from the frame members in response to a predetermined force.

16. A winch bracket assembly for a vehicle, the winch bracket assembly comprising:

first and second frame members disposed in a spaced relationship at an end of the vehicle;

a winch bracket disposed between the first and second frame members at the end of the vehicle; and first and second hook-shaped members disposed along opposite sides of the winch bracket, the first and second hook shaped members configured to connect with the first and second frame members of the vehicle, wherein the winch bracket assembly is configured to provide the winch bracket with a connective mechanical rigidity that, under an influence of an exterior force in a first direction along a longitudinal axis of the vehicle, is higher than a connective mechanical rigidity of an equivalent exterior force exerted along a second direction of the vehicle, the second direction being anti-parallel to the first direction.

17. The winch bracket assembly of claim 16, wherein the hook-shaped members are oriented such that a predetermined force imposed thereon toward an interior bight portion causes at least one of the hook-shaped members to separate from at least one of the frame members during a collision event.

18. The winch bracket assembly of claim 17, wherein the winch bracket includes a fixed connection between a lower portion thereof and at least one of the frame members, the connection allowing the winch bracket to pivot about the connection to the lower portion when the at least one hook-shaped member separates from the at least one frame member.

19. The winch bracket assembly of claim 17, wherein the first and second hook-shaped members face in a same direction.

20. The winch bracket assembly of claim 17, wherein a fastener is disposed such as to be received through an open region of the at least one hook-shaped member, the hook-shaped member configured to separate therefrom in a collision event.

* * * * *